US010695886B2

(12) United States Patent
Schneider et al.

(10) Patent No.: US 10,695,886 B2
(45) Date of Patent: Jun. 30, 2020

(54) DEVICE AND METHOD FOR MACHINING OF AN OPTICAL LENS

(75) Inventors: Gunter Schneider, Marburg (DE); Helwig Buchenauer, Dautphetal-Buchenau (DE); Ulf Börner, Marburg (DE); Klaus Krämer, Dautphetal-Friedensdorf (DE)

(73) Assignee: SCHNEIDER GMBH & CO. KG, Fronhausen (DE)

( * ) Notice: Subject to any disclaimer, the term of this patent is extended or adjusted under 35 U.S.C. 154(b) by 1046 days.

(21) Appl. No.: 14/006,825

(22) PCT Filed: Mar. 19, 2012

(86) PCT No.: PCT/EP2012/001201

§ 371 (c)(1),
(2), (4) Date: Nov. 19, 2013

(87) PCT Pub. No.: WO2012/126604

PCT Pub. Date: Sep. 27, 2012

(65) Prior Publication Data

US 2014/0073227 A1 Mar. 13, 2014

(30) Foreign Application Priority Data

Mar. 21, 2011 (EP) ..... 11002289
Apr. 1, 2011 (EP) ..... 11002726

(51) Int. Cl.

| | |
|---|---|
| ***B24B 1/00*** | (2006.01) |
| ***B24B 13/00*** | (2006.01) |
| ***B24B 27/00*** | (2006.01) |
| ***B24B 41/00*** | (2006.01) |

(52) U.S. Cl.

CPC ..... *B24B 13/0031* (2013.01); *B24B 27/0069* (2013.01); *B24B 27/0076* (2013.01); *B24B 41/005* (2013.01)

(58) Field of Classification Search

CPC . B24B 13/0031; B24B 13/0037; B24B 13/00; B24B 27/0061

USPC ..... 451/42, 43, 362, 365

See application file for complete search history.

(56) References Cited

U.S. PATENT DOCUMENTS

| | | | | |
|---|---|---|---|---|
| 6,808,445 | B2 | 10/2004 | Diehl et al. | |
| 6,826,821 | B2 | 12/2004 | Geiger et al. | |
| 6,827,093 | B2 * | 12/2004 | Muster | B08B 3/00 134/153 |

(Continued)

FOREIGN PATENT DOCUMENTS

| | | | | |
|---|---|---|---|---|
| DE | 102007042667 A1 * | 3/2009 | ..... | B24B 13/0037 |
| KR | 100790401 B1 * | 1/2008 | | |
| WO | WO 2005105372 A1 * | 11/2005 | ..... | B24B 13/0031 |

OTHER PUBLICATIONS

Ryu Byoung Hyoun, KR100790401B1 English Translation, Jan. 2008.*

*Primary Examiner* — Joseph J Hail
*Assistant Examiner* — Shantese L McDonald
(74) *Attorney, Agent, or Firm* — David S. Safran; Roberts Calderon Safran & Cole, P.C.

(57) ABSTRACT

A device and a method for machining, especially for polishing of an optical lens, are proposed, there being both a lens changing apparatus and also a separate tool changing apparatus. The lens changing apparatus is located between a working space and a conveyor apparatus for lenses and is pivotally mounted around a horizontal axis. The tool changing apparatus is located laterally next to the working space.

36 Claims, 10 Drawing Sheets

(56) References Cited

U.S. PATENT DOCUMENTS

| | | | | |
|---|---|---|---|---|
| 7,422,510 | B2 | 9/2008 | Schneider et al. | |
| 8,460,062 | B2 | 6/2013 | Schneider | |
| 2008/0051015 | A1* | 2/2008 | Schneider | B24B 13/0031 451/67 |
| 2009/0202706 | A1* | 8/2009 | Kousaka | G02B 1/10 427/8 |
| 2011/0084433 | A1* | 4/2011 | Fiedler | B24B 41/005 269/56 |

* cited by examiner

DEVICE AND METHOD FOR MACHINING OF AN OPTICAL LENS

BACKGROUND OF THE INVENTION

Field of the Invention

This invention relates to a device for machining, especially polishing, of an optical lens and to a method for machining, especially polishing, of an optical lens.

Description of Related Art

An optical lens, for example, for eyeglasses, should have certain optical properties. The associated desired optical data of the lens are determined for example, by an optician. The lenses are then machined or fabricated depending on the respectively desired optical data, the lens being provided especially with so-called free-form surfaces (for example, progressive lenses, etc.). The following description and this invention relate especially to these lenses or lens blanks which are machined according to the desired individualized optical data and are provided in particular with so-called free-form surfaces.

This invention relates especially preferably to the machining or polishing of an optical lens. In general this also applies to the machining or polishing of some other optical component, such as a mirror or the like. Accordingly the term "optical lens" should also be understood preferably in a wide sense such that it comprises other optical components. But in the following only the machining and polishing of an optical lens are the focus. Statements and explanations in this respect therefore also apply preferably accordingly to the machining or polishing of some other optical component.

German Patent Application DE 100 29 966 A1 and corresponding U.S. Pat. No. 6,808,445 B2 discloses a device for machining, especially grinding, of an optical lens, the lens being changeable by means of a lens changing apparatus. The lens changing apparatus has a loading arm which can be pivoted around a vertical axis with apparatus for picking up and setting down the lenses.

German Patent Application DE 10 2007 042 667 A1 and corresponding U.S. Pat. No. 8,460,062 B2 shows a polishing device for optical lenses. The polishing device has two fixtures for holding the blocked lenses which are to be polished and assigned motors for rotating the lenses in the machining. The lenses with their surface to be polished during machining point at least essentially down and are located in a working space. The polishing device has polishing tools which are located under the lenses and which can be turned respectively by an assigned rotary drive. The polishing device has a tool changing apparatus with a swivel arm which can be swiveled around a vertical axis.

International Patent Application Publication WO 2005/105372 A1 and corresponding U.S. Pat. No. 7,422,510 B2 discloses a workpiece changing apparatus with arms which can be swiveled around a horizontal axis. Parallel guidance of the workpieces is not possible.

U.S. Pat. No. 6,826,821 B2 discloses a handling apparatus which can be moved along a rail. The handling apparatus has swivel arms with grippers which are guided in parallel for handling of workpieces.

SUMMARY OF THE INVENTION

The object of this invention is to devise a device and a method for machining, especially polishing, of an optical lens, a simple and/or durable structure being enabled or facilitated, changing of the lenses and/or tools being simplified or facilitated and/or good lateral accessibility with a simultaneously compact structure of the device being enabled or facilitated.

This object is achieved by a device or by a method as described herein.

According to a preferred aspect of this invention, the lens changing apparatus has a swivel arm with a retaining apparatus attached to it for receiving or holding of two lenses, the retaining apparatus being pivotable for turning of the lenses. This allows a compact structure and simple and prompt changing of lenses, especially from overhead. In particular, very prompt changing can be achieved in that the swivel arm, in any case, need not be pivoted more for changing of lenses or still pivoted little as soon as the swivel arm has assumed a position adjacent to a fixture for holding of the lens to be machined for the machining.

Preferably, a second receiving apparatus of the retaining apparatus receives a lens from the fixture and grips it, a first receiving apparatus of the retaining apparatus already holding the other lens. Then, the retaining apparatus is turned or the lenses are turned in order to transfer the other lens from the other receiving apparatus onto the fixture.

Another aspect of this invention is that the device has a lens changing apparatus for changing of the lens which is located preferably between a working space and a conveyor apparatus for lenses or is pivotally mounted there. This allows a compact structure with good accessibility from the front and from the side when the conveyor apparatus is located behind the working space and/or the lens changing apparatus. Furthermore, changing of the lens can take place from overhead so that changing is altogether simplified or facilitated. Furthermore, a simple and/or durable structure is enabled or facilitated.

According to another aspect of this invention the lens changing apparatus preferably has one swivel arm which can be pivoted onto an at least essentially horizontal arm axis. In particular the arm axis runs at least essentially parallel to a conveying direction of the conveyor apparatus for the lenses. This allows a simple and/or compact structure with especially good lateral accessibility. It is especially advantageous here that the swivel arm in this changing apparatus is pivoted away up and/or to the back, as a result of which the accessibility to the working space is greatly facilitated.

Especially preferably, the swivel arm holds a retaining apparatus for holding of the lens or lenses to be changed. The retaining apparatus is especially pivotally guided such that, when the swivel arm pivots, the lens or lenses is or are guided essentially parallel or held horizontally. This is conducive to simple control or simple progression of movement.

According to another aspect of this invention, in addition to the lens changing apparatus, the device preferably has a tool changing apparatus which works independently of it for changing of the tool. In particular, the changing of the tool takes place by means of the tool changing apparatus while at the same time the lens is changed by the lens changing apparatus. This enables optimized changing of the lens and tool, and the respective changing apparatus can be optimally adapted to the lens or the tool. In this way in turn a simple and/or durable structure is facilitated or enabled.

According to another aspect of this invention, the lens changing apparatus preferably has a retaining apparatus which can receive or hold two lenses on opposite sides and/or which holds the lens to be machined by negative pressure for changing and which grips the machined lens for changing. This allows a simple and/or durable structure. Furthermore, changing of the lenses is facilitated or simplified.

Especially preferably, the axis of rotation of the tool runs at least essentially horizontally. This is conducive to a compact structure.

The indicated device and the indicated method allow especially the implementation of a low structure and/or operation from overhead, especially preferably by a user standing laterally next to it or in front of it. This facilitates not only the operation, but especially also a cleaning of the working space.

Individual aspects and features of the aforementioned and following aspects and features of this invention can be optionally combined with one another, but can also be implemented independently of one another.

Other aspects, features, advantages and properties of this invention will become apparent from the following description of a preferred exemplary embodiment with reference to the accompanying drawings.

DETAILED DESCRIPTION OF THE INVENTION

For the same or same type of components and apparatus, the figures use the same reference numbers, the same or corresponding advantages and properties arising even if a repeated description is omitted.

The subject matter of the invention is a device 1 for machining, especially polishing, of an optical lens 2 or some other optical component, even if only lenses as the preferred workpiece and polishing are addressed below.

The starting point for the formation or machining of an optical lens 2 is a lens blank. It is machined by cutting or some other profiling in further machining steps such that, at the end, there is an optical lens 2 with the desired optical properties which is finished with respect to the machining of the surface geometry. The term "lens" within the scope of this invention designates both the lens blank before carrying out the necessary machining steps, and also the finished lens 2 at the end.

The lens 2 or lens blank preferably is made of plastic. However, fundamentally, also some other material which can be suitably machined, optionally also glass or mineral glass, can be used. If the finished lens 2 is to be used for eyeglasses (not shown), which is preferably the case, the lens 2 in this invention is also called spectacle glass, even if the lens 2 may not necessarily be made of glass.

The device 1 preferably has a working space 1A in which polishing take place. The working space 1A is closed during machining or polishing.

Figure 1:
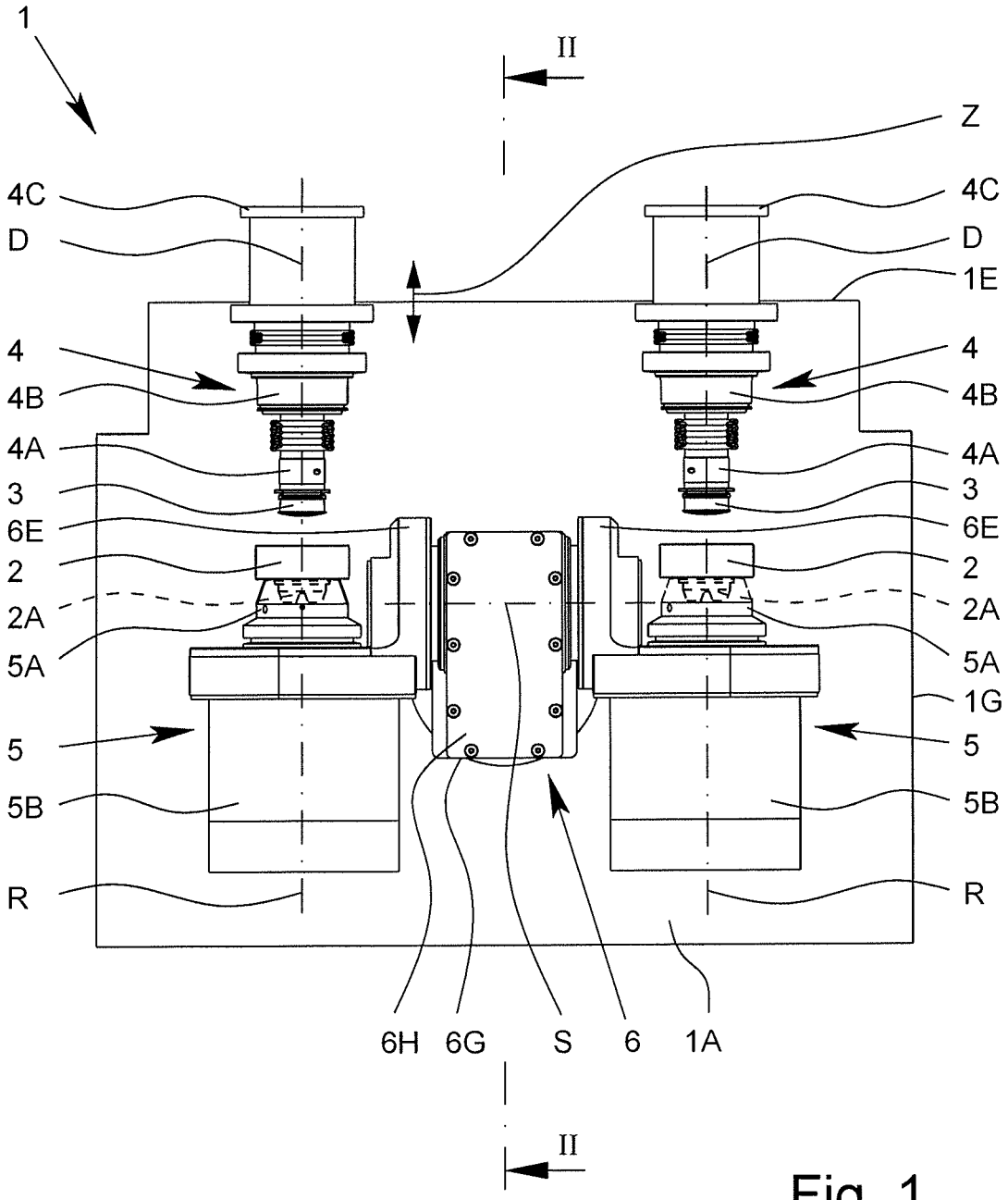
FIG. 1 is a schematic plan view of a working space of a proposed device.

FIG. 1 shows in a schematic plan view the indicated device 1 for polishing of at least one lens 2, here at the same time two lenses 2, in the region of the working space 1A.

The polishing takes place by means of a tool (polishing tool) 3 which especially turns or can be turned. In the illustrated example, there are preferably two tools 3 in order to enable the simultaneous polishing of two lenses 2.

The device 1 has a tool drive 4 in order to drive the tool 3, especially to set it into rotation. The tool 3 can therefore be turned around an axis of rotation D by means of the assigned tool drive 4. In the illustrated example, the device 1 has two tool drives 4 in order to be able to drive the two tools 3 which are intended for simultaneous machining of the two lenses 2. However, other designs are also possible. For example, there can be a common tool drive 4 for both tools 3.

The axes of rotation D of the tools 3 or tool drive 4, in the illustrated example, run preferably at least essentially horizontally and/or parallel to one another.

The device 1 preferably has a lens drive 5 for rotating the lens 2 which is to be machined, therefore polished. The lens 2 can be rotated around an axis of rotation R by means of the lens drive 5.

In the illustrated example, the device 1 preferably has two lens drives 5 in order to be able to polish preferably two lenses 2 at the same time in the illustrated example. Fundamentally, however, there can also be a common lens drive 5 for two lenses 2.

The lens drive 5 or each lens drive 5, in the illustrated example, preferably has a fixture 5A for holding or clamping the assigned, preferably blocked lens 2, especially preferably a blocking piece 2A of the lens 2, and an assigned motor 5B for driving or rotating the assigned fixture 5A and lens 2.

The fixture 5A can alternatively also directly chuck, hold or clamp the lens 2.

The lens drive 5 or the motor 5B is preferably located in the working space 1A together with the assigned fixture 5A. In the illustrated example, therefore, there are two lens drives 5 or motors 5B for driving the lenses 2 in the working space 1A of the device 1.

The device 1 is preferably made such that the fixture 5A or lens drive 5—therefore especially together with the assigned motor 5B—can be pivoted around a pivot axis S. The pivot axis S runs preferably transversely, especially perpendicular to the axis of rotation R. The pivot axis S preferably intersects the axis of rotation R or axes of rotation R.

In the illustrated example, the two fixtures 5A or lens drives 5 can preferably be pivoted around the common pivot axis S and/or only jointly.

The axes of rotation R of the two lenses 2 or lens drives 5 or motors 5B in the illustrated example, run preferably parallel to one another.

The pivot axis S runs preferably at least essentially horizontally.

The pivot axis S runs preferably through the working space 1A.

The pivot axis S runs preferably transversely, especially perpendicular to the axis of rotation D or turning axes D.

When the lens 2 is being polished or machined in the machining position which is shown in FIG. 1 and in which the fixture 5A or lenses 2 point at the tools 3, the respective axis of rotation R runs preferably at least essentially horizontally and/or at least essentially in an extension of the axis of rotation D.

The device 1 has preferably one push-rod adjustment 6 for holding and/or pivoting of the lens drive 5 or motor 5B or lens(es) 2, fixture(s) 5A or lens drives 5 and/or motors 5B.

Figure 2:
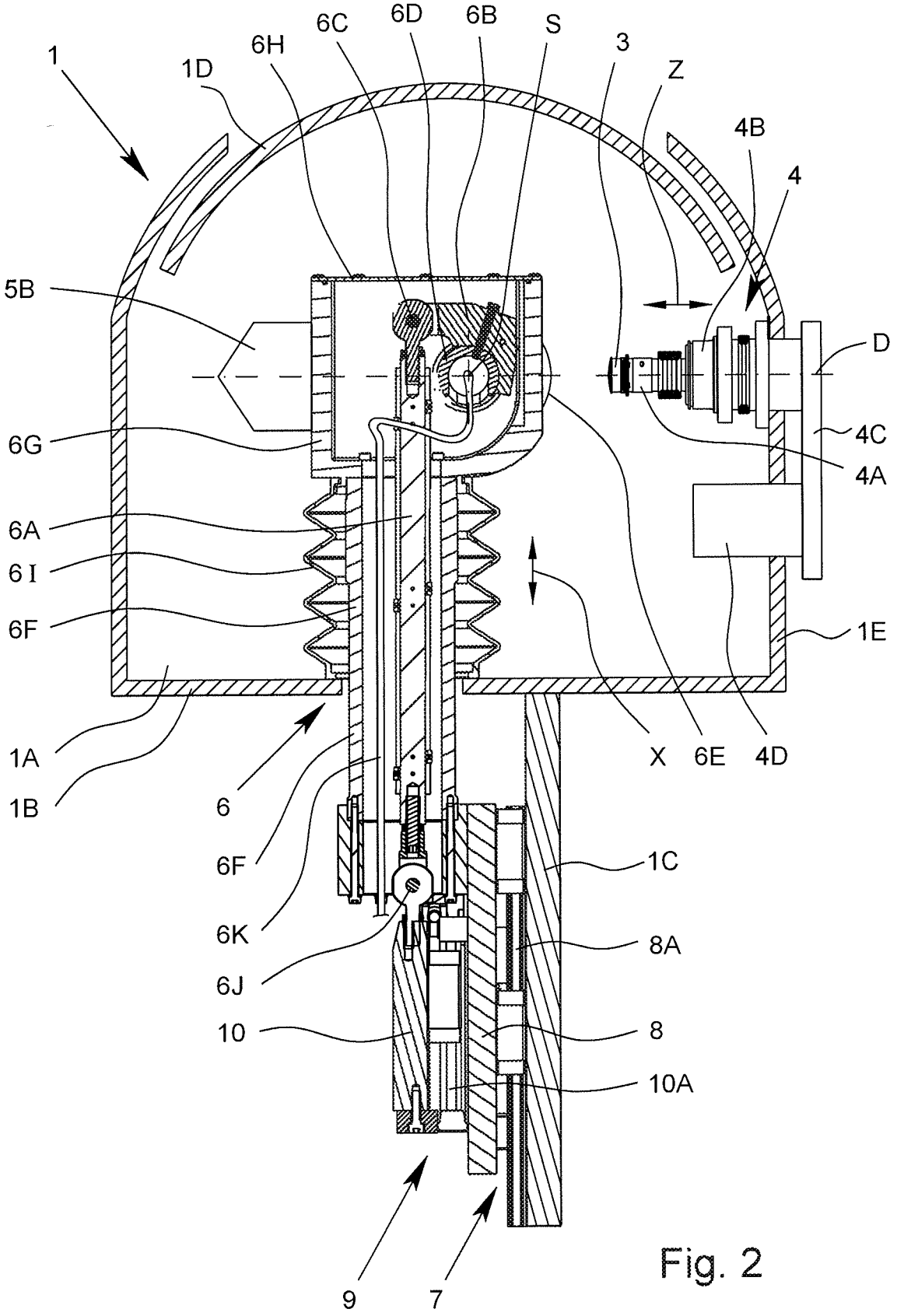
FIG. 2 is a schematic section of the device in the region of the working space taken along line II-II in FIG. 1.
Figure 3:
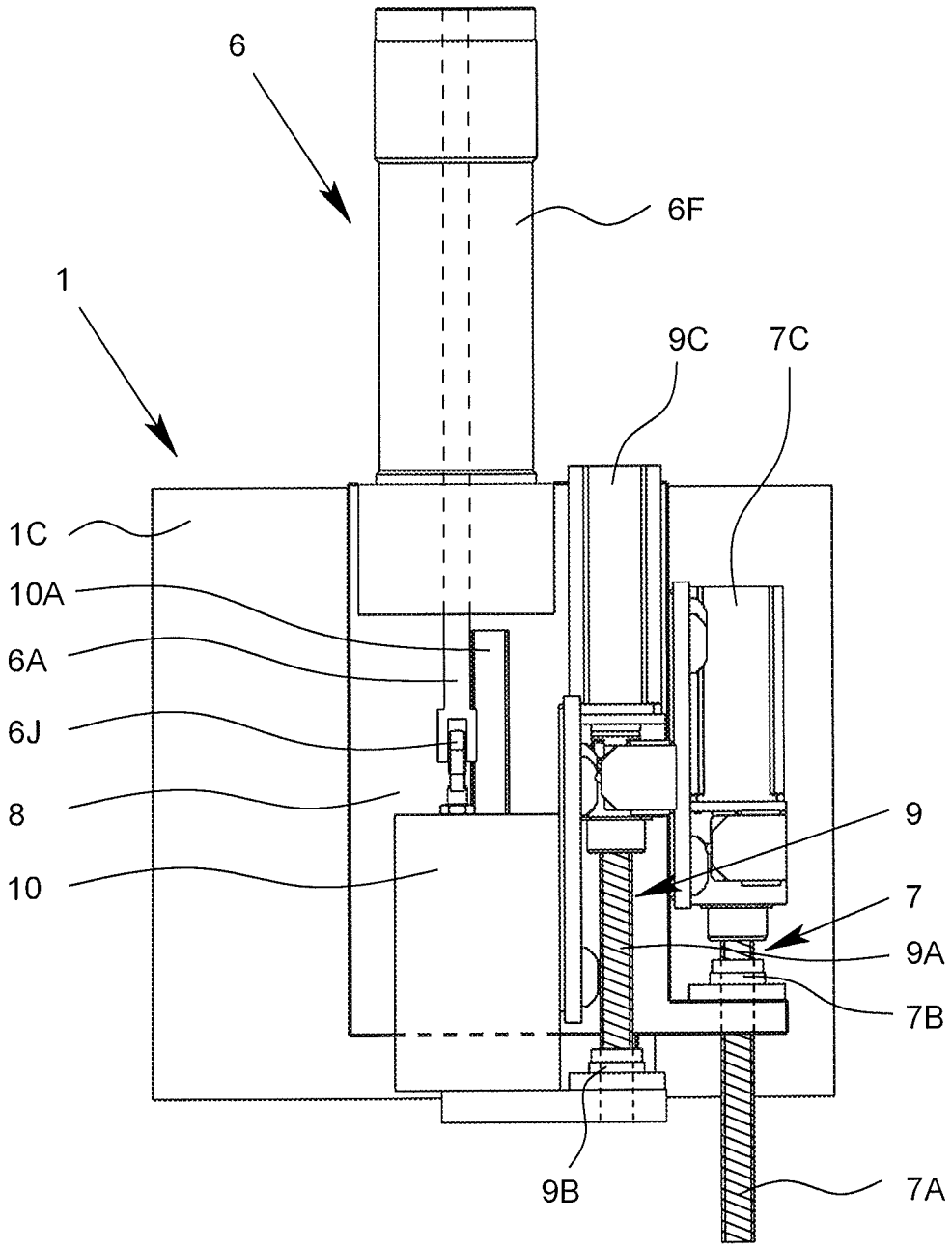
FIG. 3 is a schematic side view of a lower part of a push-rod adjustment of the device.

FIG. 2 shows the device 1 and the push-rod adjustment 6 in a schematic section along line II-II from FIG. 1, therefore in a vertical section. FIG. 3 shows a lower part of the push-rod adjustment 6 in a schematic side view.

The push-rod adjustment 6 is used preferably for the aforementioned pivoting of the fixture(s) 5A or lens(es) 2 around the pivot axis S. The push-rod adjustment 6, for this purpose, preferably has a push-rod 6A as indicated in FIG. 2. The push-rod 6A can be made in one part or several parts.

The push-rod 6A preferably acts on a cam or swivel arm 6B in order to transfer or convert the at least essentially linear push-rod motion into a rotary or pivoting movement. The push-rod 6A, in the illustrated example, is articulated via a joint 6C to the swivel arm 6B. The swivel arm 6B is connected, for example, via a shaft segment 6D and/or a holder 6E, to the lens drive 5 or two holders 6E to the lens drives 5 so as to be turned thereby.

The holders 6E, in the illustrated example, are preferably angled, as is especially apparent from FIG. 1. The holders 6E are, for example, each tightly connected to the assigned motor 5B or hold it. The motor 5B, for its part, keeps the assigned fixture 5A pivotable.

The push-rod adjustment 6 preferably has a retaining element 6F which is hollow and/or tubular and/or has a retaining head 6G, especially preferably for the rotary mounting of the swivel arm 6B, here especially, via the shaft segment 6D. In the illustrated example, the end of the retaining element 6F that projects into the working space 1A bears the retaining head 6G.

The pivot support or swivel arm 6B and the push-rod 6A are preferably encapsulated or protected or covered in the working space 1A, in the illustrated example, by the retaining element 6F which gives or holds the push-rod 6A and/or by the retaining head 6G. Especially preferably, the retaining head 6G is connected to the hollow retaining element 6F such that it closes it. The retaining head 6G in the illustrated example, preferably, for its part, is closed by a removable cover 6H or the like, especially preferably on the top.

The retaining element 6F and the push-rod 6A are preferably routed out of the working space 1A or end outside it.

The push-rod adjustment 6 or the retaining element 6F is preferably routed out of the working space 1A through an opening, especially of the bottom 1B of the device 1 or of the working space 1A. For sealing purposes, there is preferably one corresponding sealing element, here a bellows 6I, which in the illustrated example, on the one hand, is attached to the wall or the bottom 1B and on the other hand, to the retaining element 6F or retaining head 6G on the end. In particular, the sealing element or the bellows 6I is made such that a linear or axial movement of the push-rod adjustment 6 or retaining element 6F is possible, in the illustrated example, in the vertical direction or in the direction of the double-headed arrow in FIG. 2 without adversely affecting the seal.

The device 1 or the push-rod adjustment 6 preferably has a first drive 7 for at least essentially linear adjustment or displacement of the fixture(s) 5A or lens(es) 2 or the push-rod adjustment 6 or the pivot axis S, especially transversely to the axis of rotation D, in the vertical direction and/or in the X direction, as is apparent from the schematic side view of a lower part of the device 1 or of the push-rod adjustment 6 according to FIG. 3.

The first drive 7 therefore enables the movement or the cross feed of the lens 2 relative to the assigned tool 3. In particular, a computed or controlled linear axis X is formed.

In the illustrated example, the first drive 7 is located preferably outside of the working space 1A, especially underneath the bottom 1B and/or in a lower region of the device 1.

The device 1, the push-rod adjustment 6 or the first drive 7 preferably has a first slide 8 for linear guidance of the push-rod adjustment 6 or retaining element 6F. The first slide 8 therefore enables the adjustment or displacement in the X direction. In the illustrated example, the retaining element 6F is tightly connected, especially screwed, in particular in the region of its outer free end, to the first slide 8, optionally via a corresponding adapter. Especially preferably the first slide 8 which is made especially plate-like is connected laterally and/or in an extension to the preferably elongated and/or hollow section-like or tubular retaining element 6F.

The first slide 8 is movably guided especially on one base part 1C of the device 1 and/or a rail 8A, preferably in the X direction or in the longitudinal direction of the retaining element 6F and/or push-rod adjustment 6.

The first drive 7 is preferably made as a linear drive.

The first drive 7, in the illustrated example, preferably has a threaded spindle 7A for linear adjustment of the first slide 8. Especially preferably, the first drive 7 has a ball screw which is formed preferably by the threaded spindle 7A and an assigned thread part 7B which engages the threaded spindle 7A via at least one ball which is not shown. The thread part 7B, in the illustrated example, is connected to the first slide 8.

The first drive 7 preferably has a first motor 7C for drive or turning of the threaded spindle 7A or the ball screw or some other gearing.

In the illustrated example, the first slide 8 can therefore be moved or adjustment linearly or in the X direction by corresponding turning or rotation of the threaded spindle 7A.

The device 1 or the push-rod adjustment 6 preferably has a second drive 9 for pivoting of the fixture(s) 5A or lens(es) 2 and/or for (linear) actuation or adjustment of the push-rod 6A.

The second drive 9 is preferably located outside the working space 1A, especially underneath the bottom 1B and/or in a lower region of the device 1.

The device 1, the push-rod adjustment 6 or the second drive 9 preferably has a second slide 10 for linear movement or for actuating the push-rod 6A. The second slide 10 therefore enables the indicated pivoting around the pivot axis S.

Preferably, the second drive 9 acts on the outer free end of the push-rod 6A in order to be able to move or adjust the push-rod 6A at least essentially in the X direction and thus to control or cause the pivoting around the pivot axis S.

The push-rod 6A is preferably articulated via a joint 6J to the second drive 9 or second slide 10. But other designs are also possible.

Preferably, the second drive 9 is located on the first slide 8 and/or can be moved together with it. This results in that in the linear adjustment in the X direction, therefore in cross feed, or during displacement or movement by means of the first drive 7, no pivoting around the pivot axis S takes place. Rather, the linear movement or adjustment of the lens 2 relative to the tool 3 in the X direction, on the one hand, and the pivoting of the lens 2 relative to the tool 3 around the pivot axis S, on the other hand, can take place independently of one another by the first or second drive 7, 9.

In the illustrated example, a double slide arrangement is especially preferably formed. The second slide 10 sits especially on the first slide 8.

The second slide 10 is in particular movably guided on the first slide 8 or a rail 10A, preferably in the X direction or in the direction of the push-rod 6A.

The second drive 9, in the illustrated example, preferably has a threaded spindle 9A for linear adjustment of the second slide 10. Especially preferably, the second drive 9 has a ball screw which is formed preferably by the threaded spindle 9A and an assigned thread part 9B which engages the threaded spindle 9A via at least one ball which is not shown.

The second drive 9 preferably has a motor 9C for driving or turning the threaded spindle 9A or the ball screw or some other gearing.

In the illustrated example, the second slide 10 can therefore be moved linearly or in the X direction by corresponding turning or rotation of the threaded spindle 9A.

It should be noted that the second drive 9 or second slide 10 in FIG. 2 is shown in an upper position and in FIG. 3 in a lower position.

FIGS. 1 & 2 show the lenses 2 or lens drives 5 or fixtures 5A and motors 5B in a machining position. The fixtures 5A or lenses 2 point at the assigned tools 3 or at least essentially in the horizontal direction.

Figure 4:
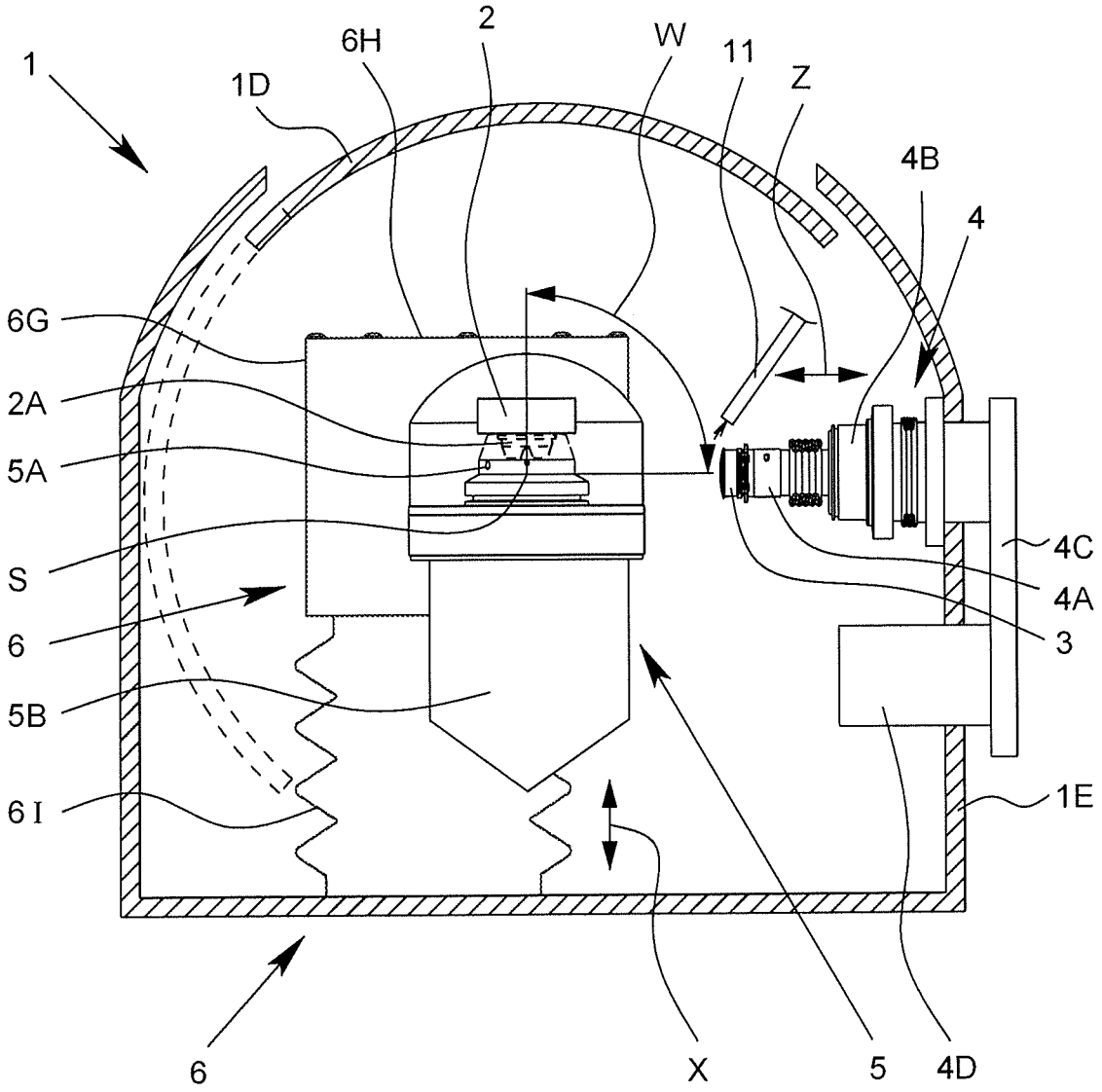
FIG. 4 is a schematic side view of the working space with the lens pivoted upward.

FIG. 4 shows in a schematic section similarly to FIG. 2 an upper part of the device 1 or the working space 1A, the lenses 2 or fixtures 5A or lens drives 5 being pivoted up or pointing up, therefore in a change position.

To change the lenses 2 and/or tools 3, the working space 1A can be opened. The device 1 has especially a cover 1D which can be moved or swung preferably onto one side of the working space 1A and/or into the working space 1A, as is indicated in FIG. 4 by the broken line. The cover 1D preferably forms a domed cover, but other designs are also possible.

The indicated device 1 and the indicated method call especially preferably for the fixtures 5A especially together with the assigned motors 5B to be able to pivot especially preferably by means of the push-rod adjustment 6 out of the machining position into the change position by an angle W, as indicated in FIG. 4. The angle W is preferably at least essentially 90°. In particular, pivoting takes place around the pivot axis S out of the machining position which is at least essentially horizontally aligned, as indicated in FIGS. 1 & 2, into the at least essentially vertically aligned change position, as indicated in FIG. 4, and vice versa.

The lenses 2 can therefore preferably be inserted, removed and/or changed from overhead. This facilitates the changing of the lenses 2.

In the illustrated example, the lenses 2 are especially preferably held or clamped via their blocking piece 2A in the assigned fixture 5A. This can take place, for example, by a corresponding clamping apparatus and/or by for example, automated chucking, clamping, suctioning, mounting or the like, for example, by an electrically motorized, hydraulic or pneumatic drive.

Required supply lines 6K, for example, for electrical power supply of the motors 5B and/or for automated chucking, holding, suctioning or clamping of the lenses 2 or blocking pieces 2A or the like, especially for electrical, pneumatic and/or hydraulic supply, are routed preferably through the push-rod adjustment 6 into the working space 1A and/or inside in the push-rod adjustment 6, as indicated in FIG. 2.

The supply lines 6K run especially through the retaining element 6F and the retaining head 6G and/or shaft segment 6D and the adjoining holders 6E, as indicated schematically in FIG. 2. The supply lines 6K can run along the push-rod 6A and/or can preferably helically surround it. The supply line 6K can, if necessary, also be attached to the push-rod 6A. However, other designs are also possible here.

When the lenses 2 are being machined or polished, the lenses or the axes of rotation R can also be tilted relative to the turning axes D of the tools 3. In the proposed structure, this tilting can take place by any angle, theoretically up to 90° so that, in particular, there is no limitation of the tilt angle during machining, as in the prior art. Accordingly, especially also lenses 2 with very high diopters can be optimally machined or polished.

In the change position, the lenses 2 are swung away from the tools 3. Accordingly, also changing of the tools 3 is facilitated.

The lenses 2 and/or tools 3 can be alternately changed manually and/or automatically, especially preferably by changing apparatus which are not shown.

Especially preferably, the changing of the lenses 2, on the one hand, and of the tools 3 on the other hand, can take place independently or separately, if necessary also at the same time, especially preferably by corresponding changing apparatus; this will be detailed below.

As already mentioned, the illustrated device 1 is made preferably for simultaneous machining or for simultaneous polishing of two lenses 2, and accordingly, also preferably has two tools 3 which can be crosslinked in rotation for machining of the two lenses 2. However, fundamentally, the device 1 can also be made only for machining of a single lens 2. In this case, a single lens drive 5 is sufficient. It can then be located especially on one side of the push-rod adjustment 6 or retaining head 6G. The lens drive 5 which is located on the other side can be omitted. Accordingly, then only a single tool drive 4 with a single tool 3 is also sufficient. The statements and explanations so far however apply accordingly.

The tool 3 can preferably be attached to the tool drive 4 via a coupling 4A. It is especially a plug-in coupling or the like.

The tool 3 can be fed preferably relative to the lens 2, especially in the direction of the double-headed arrow Z, or horizontal direction or in the direction of the axis of rotation D, as indicated in FIGS. 1, 2 & 4. This can take place especially by corresponding axial feed or adjustment of the tool drive 4 or a spindle 4B of the tool drive 4 or the like. The Z direction runs preferably parallel to the axis of rotation D.

The coupling 4A or spindle 4B can necessarily be driven directly or indirectly, for example, via a belt drive 4C, preferably by a motor 4D of the tool drive 4. In the illustrated example, the motor 4D extends especially through one rear wall 1E of the working space 1A into the working space 1A, as indicated in FIGS. 2 & 4. The belt drive 4C and/or other components are preferably located outside the working space 1A, especially preferably behind the rear wall 1E; but, other designs are also possible.

Preferably, the tool 3 is pressed or positioned with a predetermined or adjustable force against the lens 2 which is to be polished, here in the Z direction. The pressing or positioning can take place, for example, pneumatically, by spring force or in some other suitable way.

Furthermore, the tool 3 or the coupling 4A is preferably articulated to the tool drive 4 or its spindle 4B or the like or is held by it such that the tool 3 can tilt relative to the axis of rotation D and/or Z direction, and in this way, can abut and/or fit against the respective surface of the lens 2 which is to be polished. To do this, there is especially a corresponding joint, such as a ball joint or universal joint.

The polishing takes place preferably by lapping, especially therefore using a liquid which contains corresponding friction bodies, such as a so-called polishing milk or the like. Alternatively or in addition, the polishing can also take place by precision grinding. In particular, instead of lapping also only pure precision grinding can take place for final machining of the lens 2, especially prior to subsequent coating of the lens 2.

Fundamentally, the workpieces (lens 2) and tool (polishing tool 3) can also be interchanged or a kinematic reversal can be implemented.

The term "axis" (direction) especially with respect to the linear axes Y, X and Z is preferably understood within the scope of terminology in CNC controls (numerical or computerized controls) as a controlled or regulated or computed axis of movement.

The device 1 preferably has a memory-programmable control, CNC control or the like which is not shown.

The supply of a polishing agent, such as a polishing milk, takes place from obliquely overhead, for example, via a supply apparatus 11 which is indicated in FIG. 4 by the broken line and/or by the tool 3 or the tool drive 4.

Figure 5:
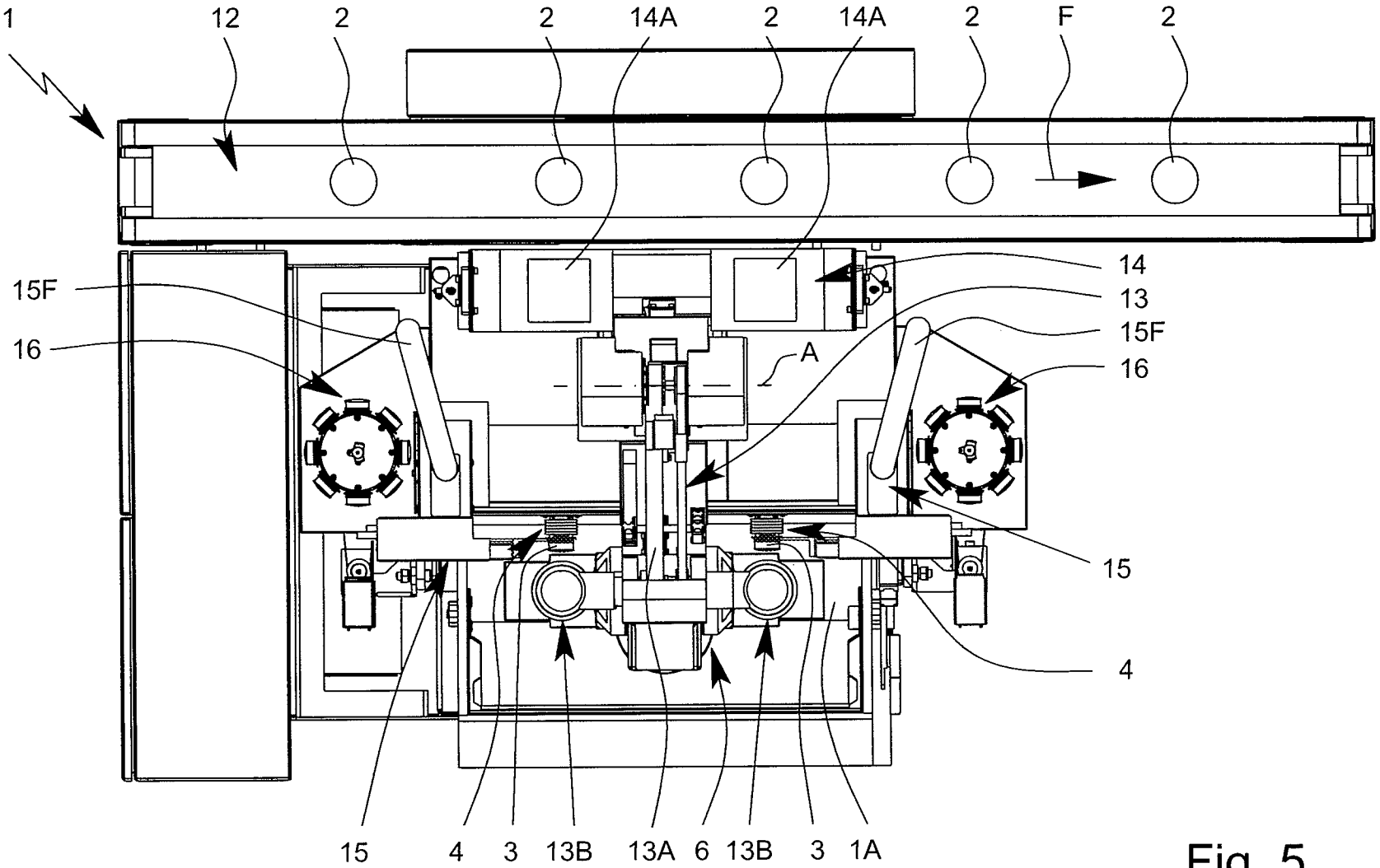
FIG. 5 is a schematic plan view of the device.

FIG. 5 shows in a schematic plan view the device 1 together with a preferably assigned conveyor apparatus 12 for lenses 2. In particular, the conveyor apparatus 12 forms part of the device 1.

The conveyor apparatus 12 is used preferably for supply of lenses 2 which have not yet been machined or which are to be machined and/or for continued conveyance of lenses 2 which have been machined in the device 1.

Especially preferably, at least essentially linear conveyance of the lenses 2 takes place in one conveying direction F (direction of arrow in FIG. 5). The conveying direction F runs preferably at least essentially horizontally and/or at least essentially parallel to the pivot axis S.

The conveyor apparatus 12 is made especially preferably as a belt conveyor.

The conveyor apparatus 12 is located preferably behind the working space 1A or behind the tool drives 4.

The conveyor apparatus 12 extends preferably over the entire length of the device 1 or determines its length. Preferably, the conveyor apparatus 12 projects laterally beyond the working space 1A such that lateral access to the working space 1A or to other components of the device 1 is maintained even if the device 1 is directly coupled to other especially identical or similar devices or their conveyor apparatus by the conveyor apparatus abutting one another on one side, and thus, enabling continuous conveyance of the lenses 2 in the conveying direction F or continuous and/or linear conveyance of the lenses 2.

The device 1 preferably has a lens changing apparatus 13 for changing of the lenses 2. In particular, the lens changing apparatus 13 allows automated changing of the lenses 2. Especially preferably, the lens changing apparatus 13 is made such that the lenses 2 to be machined can be accommodated on the conveyor apparatus 12 and can be supplied to the fixtures 5A, and that machined lenses 2 can be accommodated on the fixtures 5A and can be supplied to the conveyor apparatus 13, and the machined lenses 2 can in addition optionally be cleaned.

The lens changing apparatus 13 preferably has a swivel arm 13A and a retaining apparatus 13B for the lens(es) 2 which is preferably attached to the swivel arm 13A or held by it, in the illustrated example, especially preferably two retaining apparatus 13B for the lenses 2. Preferably, a respective retaining apparatus 13B is assigned to each fixture 5A for outfitting with a lens 2 to be machined and for removal of a lens 2 after machining.

Figure 6:
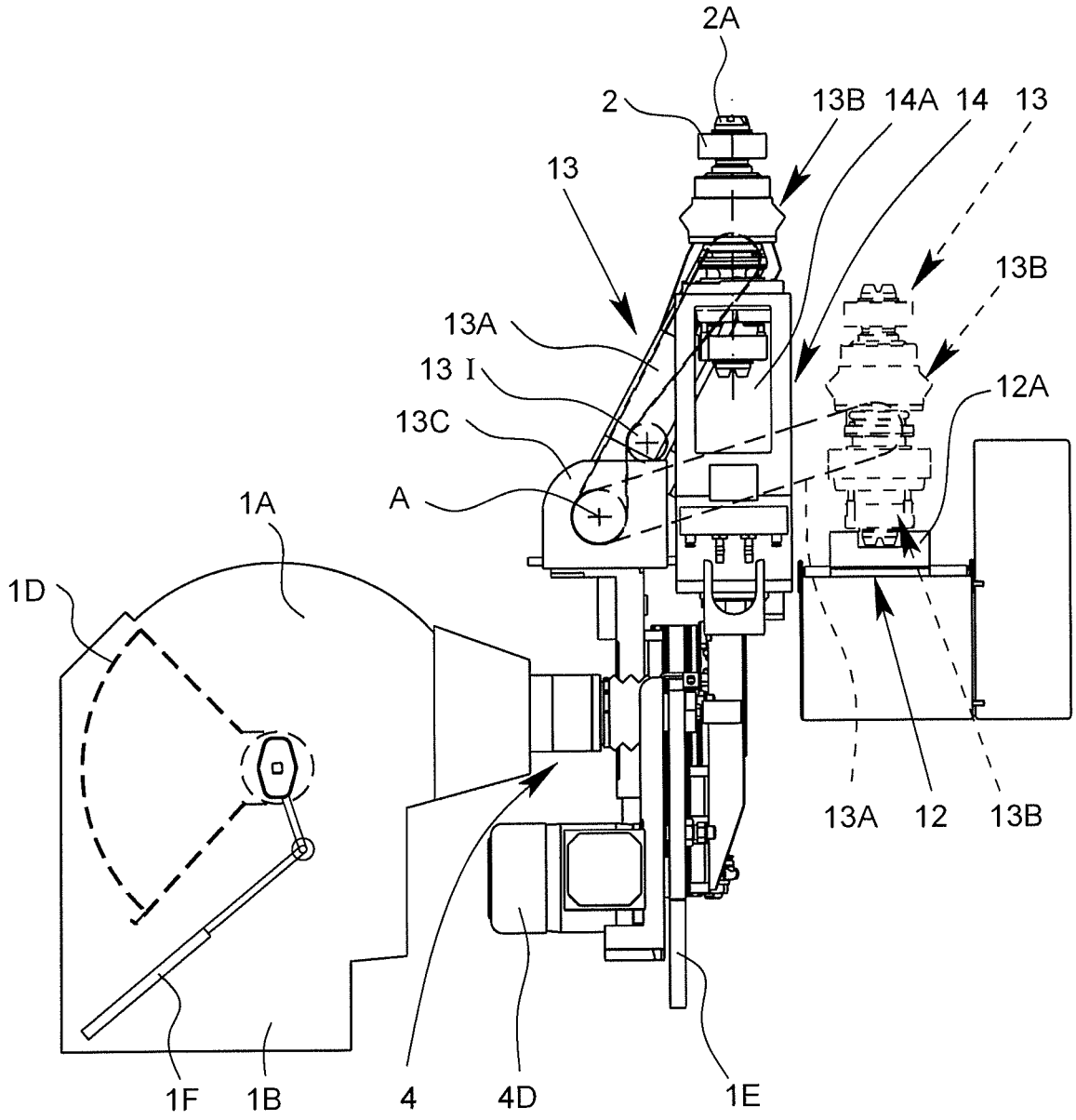
FIG. 6 is a schematic vertical section of the device.
Figure 7:
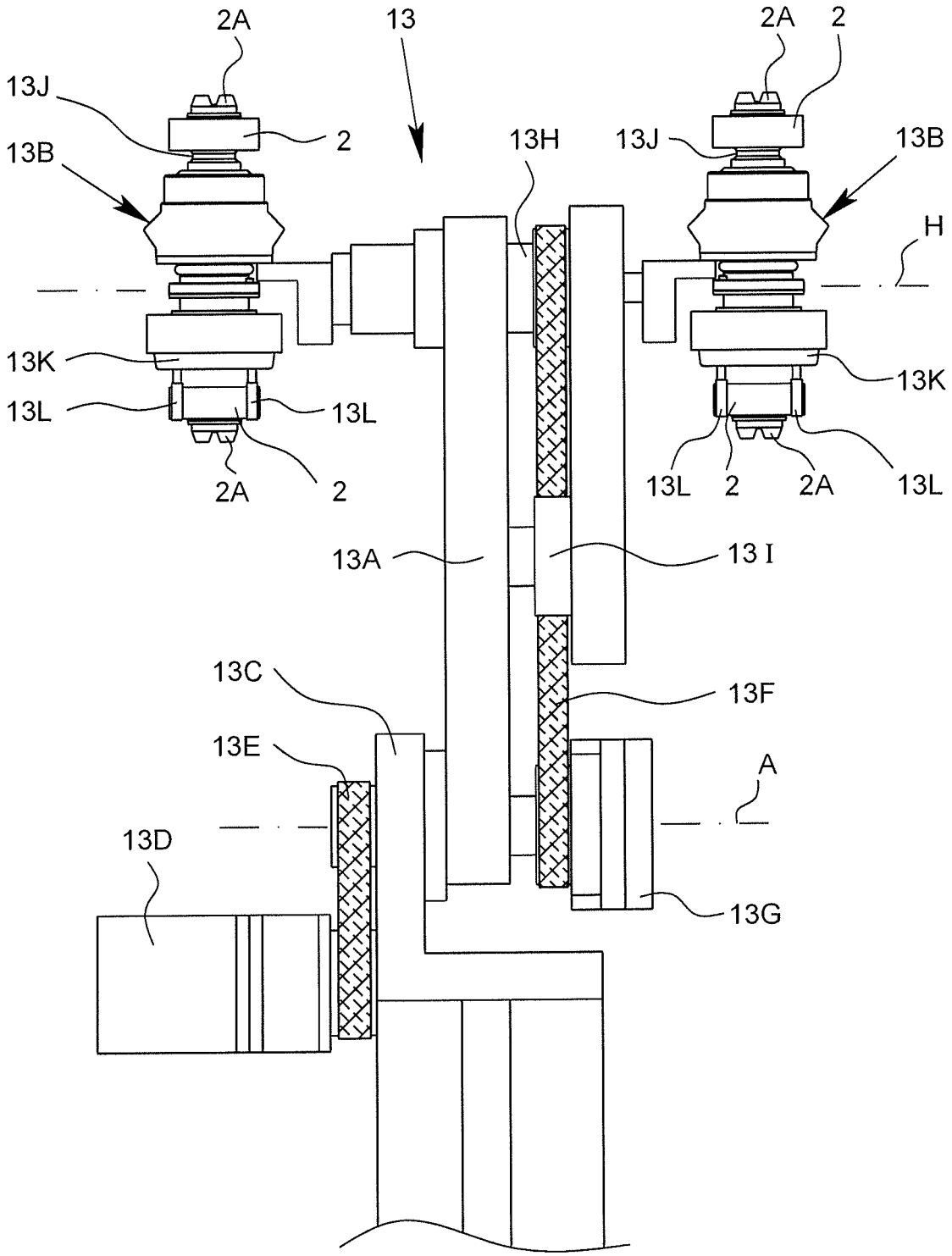
FIG. 7 is a schematic side view of a lens changing apparatus of the device.

FIGS. 6 & 7 illustrate the preferred structure of the lens changing apparatus 13. FIG. 6 shows a schematic vertical section from FIG. 5, viewed transversely relative to the conveying direction F.

FIG. 7 schematically shows the preferred structure of the lens changing apparatus 13 with the retaining apparatus 13B.

The lens changing apparatus 13, or its swivel arm 13A, preferably can be pivoted around an arm axis A. The arm axis A runs preferably at least essentially horizontally and/or at least essentially parallel to the conveying direction F and/or at least essentially parallel to the pivot axis S.

In the illustrated example, the lens changing apparatus 13 preferably has a pivot mount 13C for the swivel arm 13A.

The lens changing apparatus 13 or its pivot mount 13C is preferably located behind the working space 1A, above the working space 1A and/or between the working space 1A and the conveyor apparatus 12.

The lens changing apparatus 13 preferably has a pivot drive 13D for pivoting of the swivel arm 13A, especially via a belt drive 13E, as indicated especially in FIG. 7. However, other designs are also possible.

The two retaining apparatus 13B are preferably held or located on opposite sides and/or on the free end of the swivel arm 13A, in particular with the ability to turn around a retaining axis H (FIG. 7). The retaining axis H runs preferably parallel to the arm axis A.

The retaining apparatus 13B are preferably rotationally guided on the swivel arm 13A such that the lenses 2 are at least essentially guided parallel or held horizontally when the swivel arm 13A pivots. This can take place by a corresponding control. In the illustrated example, this takes place preferably by a belt drive 13F which correspondingly couples or balances the turning of the retaining apparatus 13B around the retaining axis H with the pivoting of the swivel arm 13A around the arm axis A. In the illustrated example, the belt drive 13F, on the one hand, is guided around a rotary drive 13G which sits on the arm axis A, and on the other hand, around a retaining shaft 13H which for its part is supported on the swivel arm 13A to be able to turn around the retaining axis H and is connected to the retaining apparatus 13B or bears them. The belt drive 13F, in the illustrated example, is optionally tensioned or can be tensioned by a tensioning roll 13I, as is indicated especially in FIG. 6.

In the illustrated example, the retaining apparatus 13B can preferably turn around the retaining axis H, especially by means of the rotary drive 13G or belt drive 13F. Especially preferably, the retaining apparatus 13B can be turned or pivoted by 180° or more.

The retaining apparatus 13B are preferably built such that they can hold the lenses 2 by negative pressure or suction and/or gripping.

The holding apparatus 13B are preferably built such that they can each receive or hold at least two lenses 2 at the same time, especially on opposite sides.

Each retaining apparatus 13B, in the illustrated example, preferably has a first receiving apparatus 13J for receiving or holding a preferably still unmachined lens 2 especially by negative pressure, especially by suction, especially preferably on the flat side of the lens 2 which is still to be machined, as well as a second receiving apparatus 13K for receiving or holding, especially preferably gripping, an especially already machined lens 2. The two receiving apparatus 13J, 13K are preferably located on opposite sides and/or preferably face away from one another. The two receiving apparatus 13J, 13K can be operated, actuated and/or controlled preferably pneumatically, hydraulically and/or electrically.

FIGS. 6 & 7 show the holding apparatus 13B with a lens on each receiving apparatus 13J, 13K for purposes of illustration, even if this does not correspond to the preferred sequence.

In the illustrated example, preferably one of the receiving apparatus, here the second receiving apparatus 13K, is made such that especially only the machined or polished lens 2 can be received or held or gripped on the border side, especially via corresponding gripping arms 13L which act in a distributed manner over the periphery, as is schematically indicated in FIG. 7.

The lens changing apparatus 13 is preferably tightly connected to the device 1 and is mounted on a machine frame of the device 1 or held by it.

The lens changing apparatus 13 or its swivel arm 13A can preferably be pivoted over or onto the conveyor apparatus 12 and over or onto the fixtures 5A or into the working space 1A. The position over the conveyor apparatus 12 is preferably called the receiving position. This is shown by the broken line in FIG. 6. The position in the working space 1A or over the fixtures 5A shown in FIG. 5 is preferably called the change position. FIG. 6 shows an intermediate position (cleaning position) of the lens changing apparatus 13 or of the swivel arm 13A (the solid line position).

The lens changing apparatus 13 or its swivel arm 13A can preferably be pivoted by essentially 180° or more in order to move between the receiving position, on the one hand, and the change position, on the other hand, or vice versa.

To change the lenses 2, the fixtures 5A or lenses 2 are preferably pivoted up, as is schematically depicted in FIG. 4. The lens changing apparatus 13 or its swivel arm 13A is moved or pivoted into the change position. The lenses 2 which have been machined to completion are received by the retaining apparatus 13B, especially the second receiving apparatus 13K, especially gripped laterally on the border or on the peripheral side. After opening of the fixtures 5A or corresponding clamping jaws or other apparatus, if necessary, the preferably still blocked lenses 2, therefore together with their blocking pieces 2A, are raised off the lens changing apparatus 13 or the retaining apparatus 13B or the second receiving apparatus 13K. This takes place preferably, first, by a relative linear movement in the vertical direction. To do this, the lens changing apparatus 13 can be moved, for example, altogether linearly in a corresponding manner, especially in the vertical direction or X direction upward, and/or the cross feed in the X direction can be used especially preferably by the push-rod adjustment 6 or the first drive 7.

Alternatively or in addition, the lens changing apparatus 13 or its swivel arm 13A can also be raised somewhat by pivoting in order to raise or withdraw the retaining apparatus 13 with the gripped lenses 13A somewhat off the fixtures 5A.

Then, the new lenses 2 or the lenses 2 which are still to be machined are placed on the fixtures 5A. This takes place here preferably in that the retaining apparatus 13B are turned or pivoted, especially by 180°, and the lenses 2 which are not yet polished or not yet machined and which are held or received by the first receiving apparatus 13J are moved (turned) via the fixtures 5A. Then, by a corresponding relative movement, especially by a relative vertical movement of the fixtures 5A and retaining apparatus 13B toward one another and/or by a corresponding pivoting of the swivel arm 13A down, the lenses 2, especially with their blocking pieces 2A, are placed on the fixtures 5A or picked up off them. After receiving or clamping or retaining the lenses 2 on the fixtures 5A, the changing of the lenses 2 is ended and the lens changing apparatus 13 can be moved or pivoted back out of the change position into the receiving position.

After changing the lenses 2, the machined or polished lenses 2 are preferably cleaned. The device 1 for this purpose has especially a corresponding cleaning apparatus 14.

In the illustrated example, the cleaning takes place when the lens changing apparatus 13 is moved or pivoted back from the change position into the receiving position. In particular the lens changing apparatus 13 or its swivel arm 13A for cleaning assumes an intermediate position which is shown in FIG. 6 and is hereinafter also called the cleaning position.

For cleaning purposes, the lenses 2 which are to be cleaned are preferably deposited in a common cleaning space 14A or separate cleaning spaces 14A of the cleaning apparatus 14 by the lens changing apparatus 13.

In the cleaning position, the cleaning apparatus 14 is moved for this purpose preferably at least essentially vertically up into an upper position, especially by means of a lifting apparatus, slide guide or the like which is not shown in detail.

FIG. 6 shows the cleaning apparatus 14 in an upper position. In this position, the lenses 2 which are held by the retaining apparatus 13B or second receiving apparatus 13K are immersed preferably into corresponding cleaning spaces 14A of the cleaning apparatus 14. The lenses 2 are deposited by corresponding opening of the retaining apparatus 13B or second receiving apparatus 13K or gripper arms 13L in the cleaning apparatus 14 or the cleaning spaces 14A. Then, the retaining apparatus 13B or second receiving apparatus 13K are moved out of the cleaning spaces 14A again, in particular by vertical movement of the cleaning apparatus 14 into a lower position. Then, the cleaning spaces 14A are preferably closed by a closing apparatus (not shown), a cover or the like.

Then, the actual cleaning process takes place, the lenses 2 being cleaned in the corresponding manner, for example, by compressed air, hot air, flushing and/or the like.

The machined or polished lenses 2 are preferably cleaned accordingly automatically.

It is noted that the cleaning of the lenses 2 is only optional. If necessary cleaning can be omitted. If necessary, the cleaning apparatus 14 can also be omitted.

In addition or alternatively, there can be cleaning of the lenses 2 before machining in the device 1 or it can be done by means of the device 1. In this case, the lens changing apparatus 13 stops accordingly in the cleaning position before the lens changing apparatus 13 is moved on into the change position.

After the cleaning process, the cleaning apparatus 14 is opened again and moved upward. At this point, the lens changing apparatus 13 can again pick up or grasp the cleaned lenses 2.

Then, the cleaning apparatus 14 again travels down into a lower position (not shown). Then, the lens changing apparatus 13 can be pivoted or moved on into the receiving position (shown by the broken line in FIG. 6) and the machined or polished lenses 2, at this point, can be deposited on the conveyor apparatus 12, especially into, for example, a tablet-like conveyor container 12A which is schematically indicated in FIG. 6. For example, the lenses 2 with their blocking pieces 2A can engage a corresponding recess or depression of the conveyor container 12A.

Then the swivel arm 13A is raised somewhat again and the retaining apparatus 13B or second receiving apparatus 13K with their gripping arms 13L are raised or pivoted up to such an extent that the conveyor apparatus 12 can further convey the lenses 2 or the conveyor container 12A in the conveying direction F.

Then, the retaining apparatus 13B are pivoted around the retaining axis H so that, at this point, preferably the first receiving apparatus 13J face down in order to next pick up the not yet machined or polished lenses 2 from or on the conveyor apparatus 12. The swivel arm 13A is then, accordingly, pivoted down until the holding apparatus 13B or first receiving apparatus 13J have picked up the lenses 2 which are to be received, especially preferably held by suction on the flat side. Then, the received lenses 2 are raised by the lens changing apparatus 13 or the retaining apparatus 13B off the conveyor apparatus 12 or a corresponding conveyor container 12A in order to then change the next lenses 2 which had been supplied beforehand to the fixtures 5A after completed machining. To do this the retaining apparatus 13B are first turned or pivoted again by 180° around the retaining axis H. Then, the changing of the lenses 2 in the change position can take place as already described after completed lens machining.

It is noted that the essentially vertical movement, when the lenses 2 are being raised off the conveyor apparatus 12 or out of a conveyor container 12A and/or when the lenses 2 are being deposited on the conveyor apparatus 12 or a conveyor container 12A, can be implemented by the pivoting motion of the swivel arm 13A, especially in at least essentially horizontal alignment of the swivel arm 13A in the receiving position and/or by a corresponding vertical movement or movement capacity of the lens changing apparatus 13 and/or conveyor apparatus 12. For example, it is possible for this desired vertical motion to be implemented accordingly by means of a manipulation apparatus or the like which is not shown, and which for example, to raise a conveyor belt of the conveyor apparatus 12 in areas.

The lens changing apparatus 13 or pivot mount 13C or arm axis A is preferably between the working space 1A and the cleaning apparatus 14 and/or the conveyor apparatus 12.

The lens changing apparatus 13 or the retaining apparatus 13B can be moved or pivoted for changing of the lenses 2, preferably from overhead and/or obliquely from the rear into the working space 1A or into the change position when the working space 1A is opened.

The working space 1A can preferably be closed or covered by the cover 1D. The cover 1D in an opened position within a housing of the working space 1A can preferably be pivoted to the side, especially can be pivoted forward, as indicated by the broken line in FIG. 6.

The opening and closing of the working space 1A or of the cover 1D or the pivoting of the cover 1D up and down take place preferably automatically, especially by means of a corresponding tilt drive 1F, as schematically indicated in FIG. 6, and/or preferably pneumatically.

Accordingly, the changing of the lenses 2 can take place automatically. For this purpose, the device 1 preferably has a correspondingly made control apparatus (not shown).

As already described, the indicated device 1 and the indicated method are preferably directed at two lenses 2 being held and machined, especially polished, at the same time. Accordingly two tools 3 which machine the two lenses 2 in parallel, especially also independently of one another at the same time, are used for this purpose. A preferred changing of the tools 3 is detailed below. This takes place especially automatically by means of a tool changing apparatus 15. Preferably, for each tool 3 or each tool drive 4, there is a separate tool changing apparatus 15. However, fundamentally, there can also be a common tool changing apparatus 15 for changing of the two tools 3. The indicated device 1 therefore has especially at least one tool changing apparatus 15, in the illustrated example, especially preferably two tool changing apparatus 15.

The corresponding also applies especially to a tool magazine 16 which is assigned preferably to the device 1 for the tools 3. A separate tool magazine 16 can be assigned to each tool changing apparatus 15 or they can also alternatively access a common tool magazine 16. In an illustrated example, the indicated device 1 therefore accordingly preferably has at least one tool magazine 16, especially two or more tool magazines 16.

In the illustrated example, the two tool changing apparatus 15 are preferably located laterally on the device 1 or on the working space 1A and/or somewhat offset to the rear or behind. Tool magazines 16 are preferably located adjacent to the tool changing apparatus 15 and/or next to or laterally next to and/or behind the working space 1A, especially as shown in the plan view from FIG. 5. The lens changing apparatus 13 is preferably located in between.

Preferably, the two tool changing apparatus 15 and the two tool magazines 16 are made at least essentially identical and/or are of the same kind, in the illustrated example, mirror-inverted. One preferred structure of a tool changing apparatus 15 and of a tool magazine 16 are explained.

Figure 8:
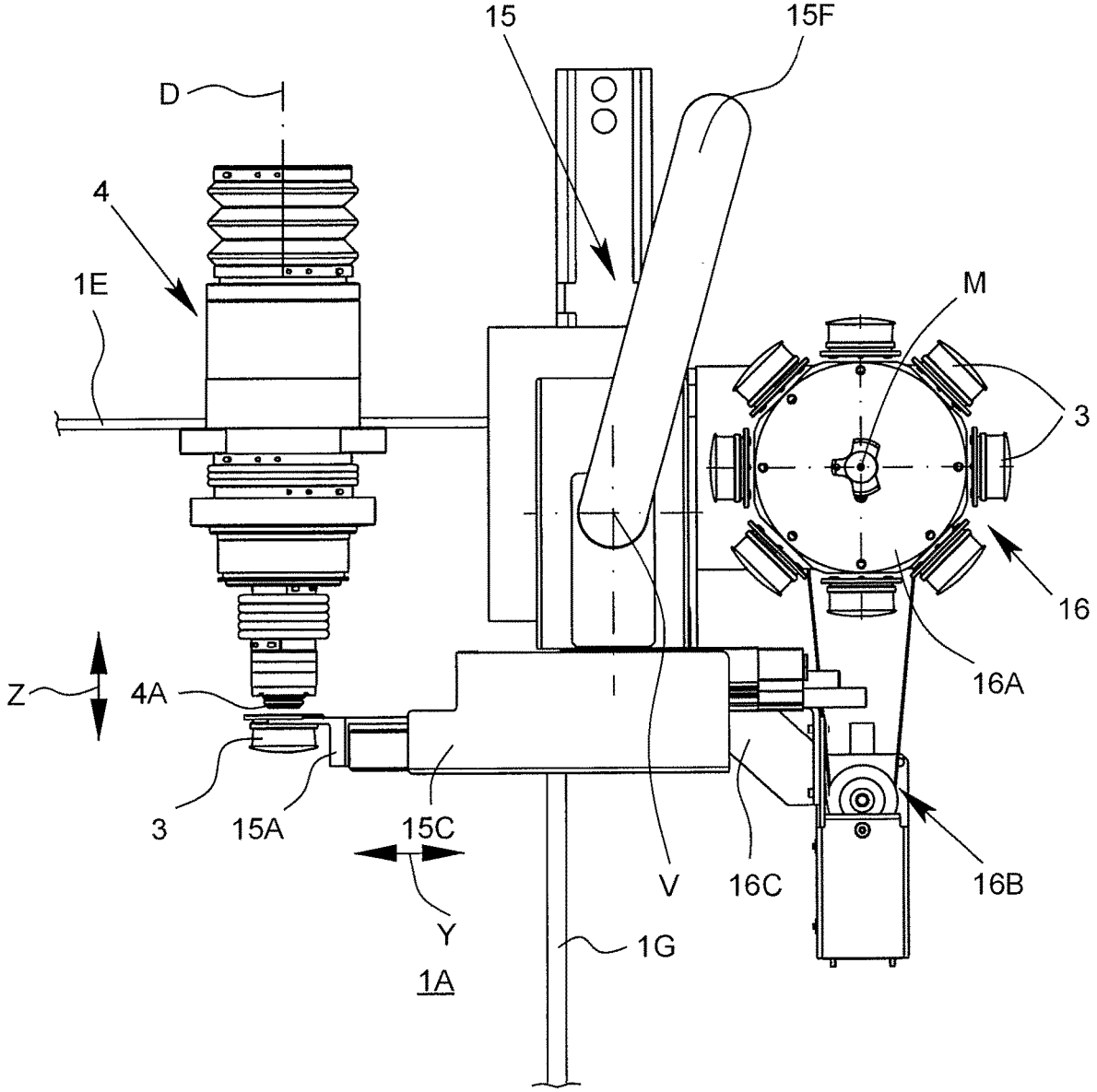
FIG. 8 is an enlarged extract from FIG. 5 to illustrate a tool changing apparatus of the device.
Figure 9:
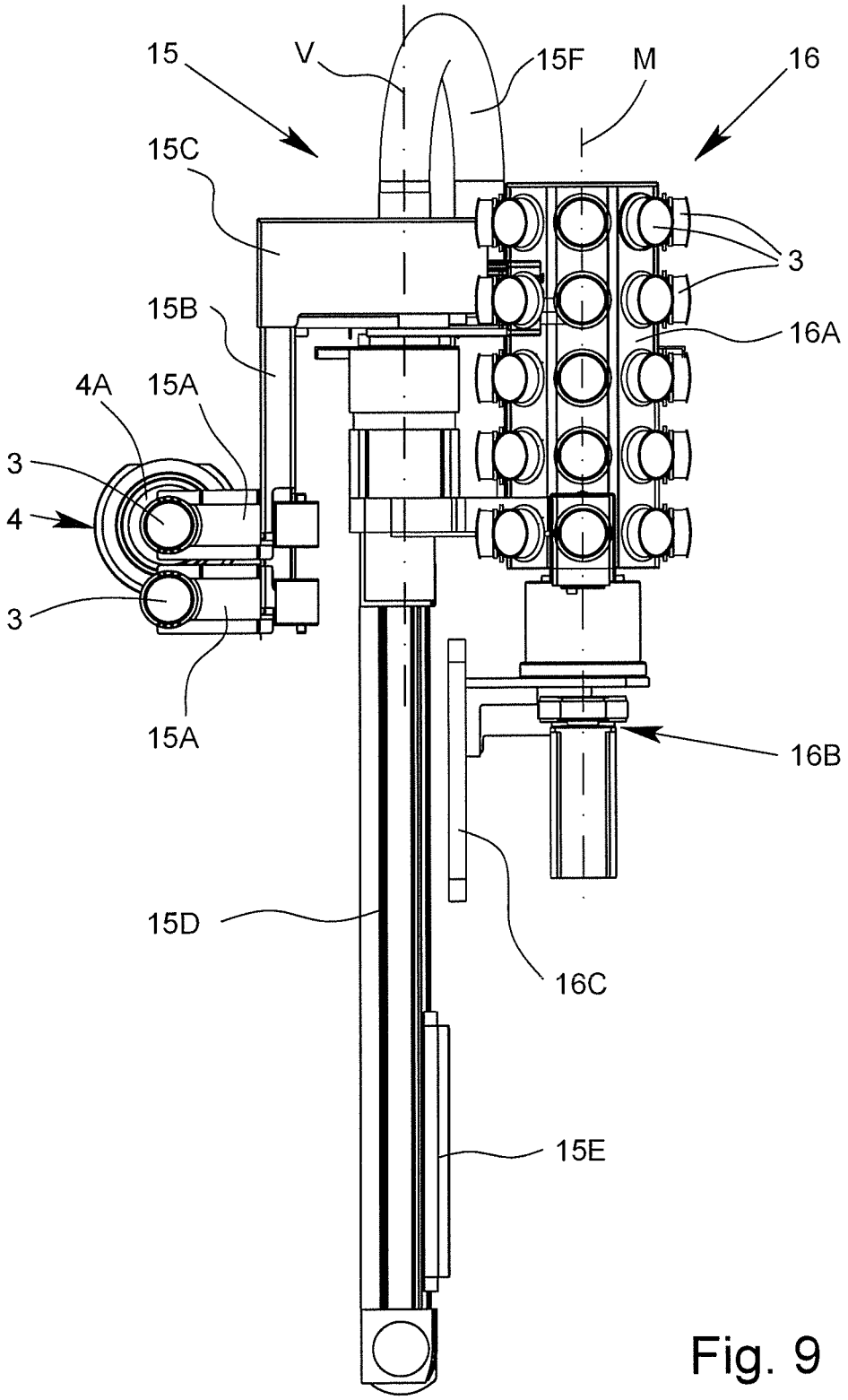
FIG. 9 is a schematic side view of the tool changing apparatus when changing a tool.
Figure 10:
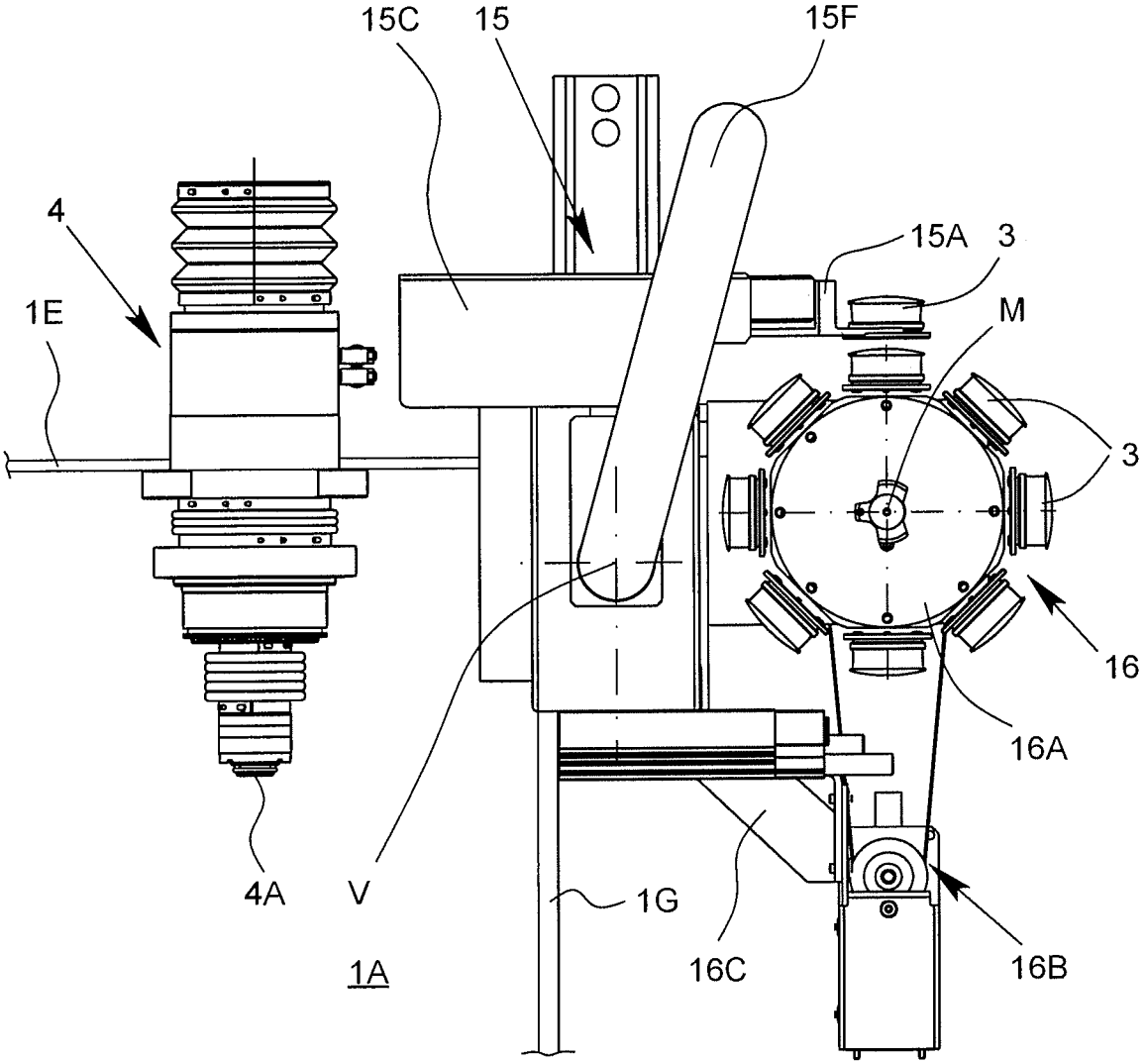
FIG. 10 is a schematic plan view of the tool changing apparatus during picking up or putting down of a tool on a tool magazine of the device.

FIG. 8 shows the tool changing apparatus 15 and an assigned tool magazine 16 of FIG. 5, the tool changing apparatus 15 holding a tool 3 to be changed over the tool drive 4 or its coupling 4A, therefore in the change position. FIG. 9 shows the tool changing apparatus 15 with the assigned tool magazine 16 in a schematic side view, other components and parts of the device 1 being omitted for the sake of clarity. FIG. 10 shows the tool changing apparatus 15 with the assigned tool magazine 16 in a schematic plan view, the tool changing apparatus 15 being shown in a receiving position as the tool 3 is being received from the tool magazine 16 or when the tool 3 is deposited on the tool magazine 16.

Tool changing apparatus 15 preferably has at least one receiving apparatus 15A for receiving, especially retaining or gripping, a tool 3. In the illustrated example, the tool changing apparatus 15 preferably has two receiving apparatus 15A, which can be opened or actuated for picking up and depositing the tools 3 preferably independently of one another. The receiving apparatus 15A are especially preferably made gripper-like. The actuation takes place preferably pneumatically, but alternatively can also take place hydraulically, electrically or in some other way.

Especially preferably a receiving apparatus 15A for receiving or gripping a tool 3 can hold or clamp it laterally or on the peripheral side. For this purpose, for example, the receiving apparatus 15A can with opened gripping tongs, be pushed from overhead, therefore proceeding from a machining or polishing side of the tool 3 essentially axially over the tool 3, and then, the gripping tongs can hold the tool by closing the gripping tongs or gripper 3. Alternatively or in addition, the receiving apparatus 15A can, for example, also be pushed laterally with its opened gripping tongs onto or over the tool 3.

The tool 3 preferably has corresponding lateral working surfaces or working means, for example, a lateral recess, a groove, preferably an annular groove, an annular shoulder or the like.

The tool 3 preferably has a coupling part that corresponds to the coupling 4A and which is not shown in detail. To attach the tool 3 to the tool drive 4, the coupling part is coupled to the coupling 4A, especially by pushing or slipping the tool 3 on axially. Here, especially a clamping and/or catch connection between the tool 3 and tool drive 4 or coupling part and coupling 4A is formed. Accordingly, in the illustrated example, the tool 3 is connected to the assigned coupling 4A or the tool drive 4 by an axial movement. Conversely, the tool 3 can be released from the tool drive 4 or coupling 4A or raised off it preferably by an axial movement; but, other designs are also possible.

In the illustrated example, the two receiving apparatus 15A of the tool changing apparatus 15 are preferably located vertically on top of one another.

The two receiving apparatus 15A make it possible for one of the receiving apparatus 15A to already be provided with a new tool 3, while the other receiving apparatus 15A first receives a tool 3 which is clamped or slipped-on or attached to the assigned tool drive 4 and detaches it before the new tool 3 can be attached to the tool drive 4 or its coupling 4A.

The tool changing apparatus 15 preferably has a retaining arm 15B which bears or holds at least one receiving apparatus 15A, in the illustrated example, both receiving apparatus 15A have gripper arms or the like provided, especially preferably in the region of a free and/or lower end, especially preferably together with corresponding drives for opening and closing the gripping tongs.

In the illustrated example, the retaining arm 15B extends preferably at least essentially in the vertical direction.

The tool changing apparatus 15 has preferably an adjustment apparatus 15C for linear, especially horizontal adjustment or movement of at least one receiving apparatus 15A or of the retaining arm 15C in the Y and/or Z direction, preferably as shown in FIG. 8, and/or for pivoting of at least one receiving apparatus 15A or of the retaining arm 15B, especially preferably around a vertical axis V that is represented by a double-headed arrow in FIG. 8.

Especially preferably, the adjustment device 15C keeps the retaining arm 15B alternately tight or over a joint.

In the illustrated example, the tool changing apparatus 15 or adjustment apparatus 15C is preferably made such that movement in the change position of FIGS. 5 & 8, at least in the Z direction or along the axis of rotation D or in the axial direction of the tool 3, is enabled in order to lift the tool 3 alternately off the assigned tool drive 4 or the coupling 4A or to attach it thereto. In addition, especially preferably, movement is possible or provided transversely or perpendicular thereto in the horizontal Y direction for lateral centering or alignment and/or especially in order to be able to move the receiving apparatus 15A laterally over or onto the tool 3 or away from it.

In the illustrated example, at least one receiving apparatus 15A can preferably be pivoted, especially around the vertical axis V, especially to move at least one receiving apparatus 15A alternately in front of the tool drive 4 and the tool magazine 16 or to move it between the change position and receiving position or vice versa. Therefore, the V axis is preferably at least essentially between or in the middle between the change position and the receiving position or the tool magazine 16 and the coupling 4A.

In the illustrated example, the adjustment device 15C can, itself, be pivoted, especially around the vertical axis V. For this purpose, the adjustment device 15C can preferably be turned or pivoted and held on a retaining element 15D of the tool changing apparatus 15. The retaining element 15D, in the illustrated example, is preferably made as a section, stand, rail, linear drive or the like. The retaining element 15D extends especially at least essentially vertically and/or in the direction of the axis for pivoting, here the vertical axis V. However, other designs are also possible.

The tool changing apparatus 15, or the at least one receiving apparatus 15A, can be adjusted or moved preferably also vertically, therefore also in the X direction. In the illustrated embodiment, for this purpose, preferably the retaining arm 15B, the adjustment apparatus 15C and/or the retaining element 15D can be moved or adjusted accordingly vertically, especially preferably by its implementation as a linear drive or slide guide which can be moved or pushed relative to a stationary slide 15E of the retaining element 15D, as indicated schematically in FIG. 9, or relative to some other part, and/or by a corresponding adjustment drive, screw drive or the like (not shown).

The tool changing apparatus 15 preferably has a line guide 15F which supplies required supply lines, for example, compressed air line, electrical lines or the like especially preferably from overhead and/or in the region of the pivot axis or vertical axis V. In the illustrated example, the line supply 15F is made especially bent, semicircular or arc-like and/or ends on the adjustment apparatus 15C and/or coaxially to the pivoting or vertical axis V, especially preferably via a corresponding rotary connection so that the pivoting motion, here of the adjustment apparatus 15C, is easily possible and/or the receiving apparatus 15 can be moved or pivoted within the line supply 15F which runs preferably in a semicircle. But, other designs or arrangements are also possible. For example, the supply lines can be supplied from underneath and/or through the retaining element 15D which is preferably hollow.

The tool magazine 16 preferably has an especially essentially drum-like or cylindrical magazine body 16A for detachable holding of the tools 3. The tools 3 can preferably be attached to certain support sites by insertion or clamping.

In the illustrated example, the tools 3 or their support sites are arranged distributed over the periphery and/or axially on the magazine 16 or magazine body 16A. In other words, the magazine body 16A has preferably defined or correspondingly arranged receiving means, holders or the like at certain support sites.

Preferably, the magazine body 16A can be turned, here around the indicated magazine axis M. In particular, here, it is the cylinder axis or the axis of rotation of the magazine 16A. The magazine axis M runs preferably at least essentially vertically.

The tool magazine 16 preferably has a magazine drive 16B for defined turning or pivoting of the magazine body 16A around the magazine axis M. The magazine drive 16B, in the illustrated example, has especially preferably, a motor with a corresponding belt drive. However, other designs are also possible.

The magazine body 16A can preferably be turned in defined steps so that an axial row of tools 3 or support sites always comes to rest in a certain turning position or peripheral position so that, in this axial row, it is possible to receive and/or deposit tools 3 by means of the tool changing apparatus 15 or its receiving apparatus 15A, as shown in FIG. 10.

The tool magazine 16 is preferably attached tightly to the device 1 or a frame of the device 1 or is held by it, here in particular, via a magazine frame 16C, as indicated schematically in FIG. 9.

Preferred changing of the tools 3 or of one tool 3 is explained below by way of example.

The changing of the tool 3 or tools 3 takes place by means of at least one tool changing apparatus 15, preferably independently of the changing of the lenses 2, but preferably at the same time or while at least one lens 2 is being changed by the separate lens changing apparatus 13.

FIG. 9 shows a change position of the tool changing apparatus 15, the retaining arm 15B with the receiving apparatus 15A already having been moved into the working space 1A to the assigned tool drive 4. In the situation shown in FIG. 9, an already used tool 3 has already been received by a receiving apparatus 15A, therefore already detached from the coupling 4A of the tool drive 4 and is kept in the lower receiving apparatus 15A. At this point, the new tool 3 or the tool which is to be newly attached and which is being held by another, here, the upper receiving apparatus 15A, is attached, in particular coupled to the tool drive 4 or its coupling 4A, especially by being pushed or slipped on axially, i.e., in the Z direction or horizontal direction.

Then, the used tool 3, together with the retaining arm 15B, is moved out of the working space 1A, here, by an upward vertical movement, especially by corresponding vertical movement of the retaining element 15D. Then, pivoting, here, around the vertical axis V, into the receiving position or toward the tool magazine 16 or its magazine body 16A takes place, in the illustrated example, in FIG. 8, clockwise and/or especially preferably by essentially 180°. The pivoting takes place here by a turning or pivoting of the adjustment apparatus 15C by means of an assigned pivot drive (not shown) and which is preferably integrated into the adjustment apparatus 15C. But, other designs are also possible, as already mentioned.

Then, if necessary, a vertical movement takes place in order to move the receiving apparatus 15A with the used tool 3 to the correct height in order to be able, afterwards, to deposit this tool 3 on a free support site on the magazine body 16A, especially by a corresponding horizontal movement of the retaining arm 15B, together with the corresponding receiving apparatus 15A, toward the magazine body 16A or in the Z direction.

Preferably, used tools 3A are always deposited in the lowermost free position and/or only next to or preferably underneath tools 3 which have not yet been used or which are to be used later, in order to avoid fouling of tools 3 which have not yet been used or which are to be used later, for example, by polishing agents or the like dripping down.

Alternatively or in addition, there can optionally also be a cleaning apparatus for cleaning of used tools 3. The tool changing apparatus 15 then moves a used tool 3 preferably first into a cleaning position or into this cleaning apparatus before the tool 3 is deposited on the tool magazine 16 or its magazine body 16A.

After depositing a tool 3 on the tool magazine 16, the tool changing apparatus 15 or its receiving apparatus 15A can again pick up a new tool or another tool 3, especially grasp it or grip it, which tool is needed next and which is to replace the tool 3 currently in use.

Then, during the next tool change, the tool changing apparatus 15 or its retaining arm 15B or its fixture(s) 15A can be pivoted over the working space 1A and can be moved into the working space 1A into the change position.

In the illustrated embodiment, the tool changing apparatus 16 is therefore especially arm-like having a movable arm that is preferably articulated, and/or also able to move telescopically or linearly.

The at least one receiving apparatus 15A is made especially preferably as a gripper or gripping apparatus for gripping of the tool 3.

FIG. 8 schematically shows a side wall 1G of the working space 1A. Preferably, the tool changing apparatus 15 or its adjustment device 15C extends over this side wall 1G, at least in the change position, in order to be able to reach into the working space 1A to the tool drive 4 or its coupling 4A.

In particular, the different directions of movement of tool changing apparatus 15 in the X, Y and/or Z direction form corresponding, controlled linear axes and/or pivoting around the vertical axis V.

What is claimed is:

1. A device for machining of an optical lens by means of a tool which is rotatable around an axis of rotation, comprising:

a fixture for holding a blocked lens;

a coupling for holding a tool;

a closed working space in which machining of the lens takes place; and a lens changing apparatus for changing the lens, the lens changing apparatus having a swivel arm and a retaining apparatus for the lens rotationally attached to the swivel arm;

wherein the retaining apparatus comprises a first receiving apparatus and a second receiving apparatus, the first receiving apparatus receiving or holding a still unmachined lens by negative pressure, wherein the swivel arm is pivotable around an at least essentially horizontal arm axis, wherein the lens changing apparatus is located between the working space and a lens conveying apparatus for conveying of lenses, and wherein a conveying direction of the lens conveying apparatus runs at least essentially parallel to the arm axis.

2. The device as claimed in claim 1, wherein the retaining apparatus is built such that it can receive or hold at least two lenses at the same time by means of the first and second receiving apparatus.

3. The device as claimed in claim 1, wherein the second receiving apparatus has means for gripping only a machined lens.

4. The device as claimed in claim 1, wherein the retaining apparatus is rotationally guided on the swivel arm such that the lens(es) is or are at least essentially guided parallel or held horizontally when the swivel arm pivots.

5. A device for machining of an optical lens by means of a tool which is rotatable around an axis of rotation, comprising:

a fixture for holding a blocked lens;

a coupling for holding a tool;

a closed working space in which machining of the lens takes place;

a lens changing apparatus for changing the lens, the lens changing apparatus having a swivel arm and a retaining apparatus for the lens rotationally attached to the swivel arm; and a tool changing apparatus for a changing of the tool which works independently of the lens changing apparatus;

wherein the swivel arm is pivotable around an at least essentially horizontal arm axis, wherein the lens changing apparatus is located between the working space and a lens conveying apparatus for conveying of lenses, and wherein a conveying direction of the lens conveying apparatus runs at least essentially parallel to the arm axis.

6. The device as claimed in claim 5, wherein the device has two tool magazines located laterally next to the working space.

7. The device as claimed in claim 6, wherein the tool magazines are located adjacent to the tool changing apparatus.

8. The device as claimed in claim 6, wherein the tool magazines are made essentially identical or of the same kind.

9. The device as claimed in claim 6, wherein each of the tool magazines has a magazine body rotatable around a magazine axis, and wherein the magazine axis runs vertically.

10. The device as claimed in claim 6, wherein the lens changing apparatus is located between the two magazines.

11. The device as claimed in claim 5, wherein the device has two retaining apparatus attached to the swivel arm.

12. The device as claimed in claim 11, wherein the two retaining apparatus are held on opposite sides and/or on a free end of the swivel arm.

13. The device according to claim 5, wherein the retaining apparatus has two receiving apparatus for receiving or holding lenses, each of which is rotatable on the swivel arm for turning the retaining apparatus relative to the swivel arm as the swivel arm pivots, wherein the two receiving apparatus are located on opposite sides of the retaining apparatus, wherein the two receiving apparatus comprise a first receiving apparatus for receiving or holding only a still unmachined lens, and a second receiving apparatus for receiving or holding a machined lens, wherein the device has two tool magazines located laterally next to the working space, wherein the lens changing apparatus is located between the two magazines, and wherein each of the tool magazines has a magazine body rotatable around a magazine axis, and wherein the magazine axis runs vertically.

14. The device as claimed in claim 5, wherein the lens conveying apparatus is a belt conveyor.

15. The device as claimed in claim 5, wherein the device comprises two tool changing apparatus.

16. The device as claimed in claim 5, further comprising a lens cleaning apparatus for cleaning lenses.

17. The device as claimed in claim 16, wherein the device comprises a lens conveying apparatus for conveying of lenses, and wherein the cleaning apparatus is located one of behind the working space, behind the lens changing apparatus and between the working space and the lens conveying apparatus, and wherein the lens changing apparatus is movable through at least 180° from a position over the working space to a position over the lens conveying apparatus via an intermediate position at the lens cleaning apparatus.

18. The device as claimed in claim 16, wherein the cleaning apparatus is vertically movable.

19. The device as claimed in claim 5, wherein the lens changing apparatus is adapted for simultaneous changing of two lenses.

20. The device according to claim 5, wherein the retaining apparatus has two receiving apparatus for receiving or holding lenses, each of which is rotatable on the swivel arm for turning the lenses which are held by the retaining apparatus.

21. A device for machining of an optical lens by means of a tool which is rotatable around an axis of rotation, comprising:

at least one fixture for holding the lens;

at least one coupling for holding a tool;

a working space in which machining of the lens takes place;

a lens conveying apparatus for conveying of lenses;

a lens changing apparatus for changing the lens with a swivel arm and a retaining apparatus attached thereto for the lens; and a tool changing apparatus which works independently of the lens changing apparatus for changing the tool, wherein the retaining apparatus has two receiving apparatus for receiving or holding lenses and is turnable on the swivel arm for turning the lenses which are held by the retaining apparatus, and wherein the retaining apparatus is rotationally guided relative to the swivel arm such that the lenses are held in the same horizontal orientation when the angular orientation of the swivel arm changes as the swivel arm turns.

22. The device as claimed in claim 21, wherein the two receiving apparatus are located on opposite sides of the retaining apparatus from one another.

23. The device as claimed in claim 21, wherein the retaining apparatus is built such that it can receive or hold at least two lenses at the same time by means of the receiving apparatus.

24. The device as claimed in claim 21, wherein the retaining apparatus has a first of the two receiving apparatus has means for receiving or holding a still unmachined lens by negative pressure.

25. The device as claimed in claim 24, wherein a second of the two receiving apparatus has means for gripping a machined lens.

26. The device as claimed in claim 21, wherein the lens conveying apparatus is a belt conveyor.

27. The device as claimed in claim 21, wherein the lens conveying apparatus is located behind the working space.

28. The device as claimed in claim 21, wherein a conveying direction of the lens conveying apparatus runs at least essentially parallel to a swivel axis of the fixture.

29. The device as claimed in claim 21, wherein the device has two retaining apparatus attached to the swivel arm.

30. The device as claimed in claim 29, wherein the two retaining apparatus are held on opposite sides of the swivel arm.

31. A device for machining of an optical lens by means of a tool which is rotatable around an axis of rotation, comprising:

a fixture for holding a blocked lens;

a coupling for holding a tool;

a closed working space in which machining of the lens takes place; and a lens changing apparatus for changing the lens, the lens changing apparatus having a swivel arm and a retaining apparatus for the lens rotationally attached to the swivel arm;

wherein the retaining apparatus has two receiving apparatus for receiving or holding lenses, each of which is rotatable on the swivel arm for turning the lenses which are held by the retaining apparatus, wherein the two receiving apparatus are located on opposite sides of the retaining apparatus, wherein the swivel arm is pivotable around an at least essentially horizontal arm axis, wherein the lens changing apparatus is located between the working space and a lens conveying apparatus for conveying of lenses, and wherein a conveying direction of the lens conveying apparatus runs at least essentially parallel to the arm axis.

32. The device according to claim 31, wherein the two receiving apparatus comprise a first receiving apparatus for receiving or holding only a still unmachined lens, and a second receiving apparatus for receiving or holding a machined lens.

33. The device as claimed in claim 31, wherein the device has two retaining apparatus attached to the swivel arm.

34. The device as claimed in claim 33, wherein the two retaining apparatus are held on opposite sides and/or on a free end of the swivel arm.

35. The device as claimed in claim 31, wherein the retaining apparatus is built such that the retaining apparatus can receive or hold at least two lenses at the same time by means of the receiving apparatus.

36. The device as claimed in claim 31, wherein the retaining apparatus is rotationally guided on the swivel arm such that the lens(es) is or are at least essentially guided parallel or held horizontally when the swivel arm pivots.

* * * * *